United States Patent [19]

Andreev et al.

[11] 4,311,769

[45] Jan. 19, 1982

[54] MERCURY CONTACT

[76] Inventors: Oleg M. Andreev, 3 Frunzenskaya ulitsa, 14, kv. 7; Anatoly V. Zakurdaev, Proletarsky prospekt, 79, kv. 66; Vladimir I. Vyzhimov, ulitsa Vostrukhina, 6, korpus 2, kv. 48, all of Moscow, U.S.S.R.

[21] Appl. No.: 20,081

[22] Filed: Mar. 13, 1979

[51] Int. Cl.[3] ..... H01H 1/08

[52] U.S. Cl. ..... 428/642; 200/262; 200/264; 200/267; 200/235; 335/58; 428/657; 428/929

[58] Field of Search ..... 204/39, 40, 45 A; 427/123; 200/262, 264, 267, 235; 428/929, 642, 657; 335/58; 75/169

[56] References Cited

U.S. PATENT DOCUMENTS

| | | | |
|---|---|---|---|
| 2,094,483 | 4/1937 | Weder | 428/657 |
| 2,389,131 | 11/1945 | Bloom | 428/642 |
| 2,850,382 | 9/1958 | Kelly et al. | 75/169 |
| 2,918,414 | 12/1959 | Schaer | 204/45 A |
| 3,018,354 | 1/1962 | Pollard | 335/58 |
| 3,114,811 | 12/1963 | Kohman | 335/58 |
| 3,322,516 | 5/1967 | De Minjer | 204/40 |
| 3,650,825 | 3/1972 | Lihl | 428/929 |
| 3,711,383 | 1/1973 | Schiekel et al. | 204/40 |
| 4,066,859 | 1/1978 | Steinmetz | 200/267 |

OTHER PUBLICATIONS

Bukhman, "Anodic Oxidation of Two-Phase Antimony Amalgams", C.A. 74, 37671y, 1971.

Zebreva, "Electrolysis of Antimony With Mercury Cathode", C.A. 54, 23999, 1959.

Zaichko, "Anodic Stripping Analysis", C.A. 67, 121809n, 1967.

Cuthrell, "An Evaluation of Amalgamated Metallic Surfaces . . . In Electrical Contact Applications", IEEE Trans. Parts, Hybrids, Package, 1975, vol. 11, No. 2, pp. 114–120.

*Primary Examiner*—John D. Smith

*Attorney, Agent, or Firm*—Lilling & Greenspan

[57] ABSTRACT

The mercury contact comprises a solid metal base of antimony, wetted with mercury. The method of manufacturing the mercury contact includes preparing the solid metal base by electrolytic deposition of antimony onto the substrate, and subsequently coating the antimony with a layer of mercury.

1 Claim, No Drawings

MERCURY CONTACT

FIELD OF THE INVENTION

This invention relates to mercury-wetted contacts for electric switching devices and to the technology of their manufacture.

A mercury contact constructed in accordance with the present invention is intended for use as a component of various switching apparatus and devices.

BACKGROUND OF THE INVENTION

There are widely known mercury of mercury-wetted contacts for switching devices, comprising a solid metal base made of platinum, iron, nickel, or metals of the chromium subgroup, viz. tungsten, molybdenum, as well as the methods of manufacturing of such contacts, including wetting the cleaned and degreased solid metal base(made of iron and nickel) with mercury by periodic dipping of the base into a mercury-containing liquid medium.

The noble metals acting as the base of the hitherto known mercury contacts are prone to forming intermediate phases and chemical compounds with the mercury, which matter accumulates at the contact junction and eventually affects the electric and dynamic characteristics of the mercury contact, and, hence, its reliability and durability.

The hitherto known mercury contact having iron for its solid metal base is produced by periodic dipping of the pre-coated iron base into a sodium amalgam through either a weak solution of a mineral acid or water.

(See, for instance, "Working with Mercury under Laboratory and Production Conditions" by P. P. Pugatchevitch, in Russian, NAUKA Publishers, Moscow, 1972, p. 183).

Iron, as well as nickel and the metals of the chromium subgroup practically would not react with mercury. However, these metals are thermodynamically unstable on account of their being electrochemically active, which activity is significantly enhanced by contact with mercury featuring a high positive potential.

Consequently, the contact junction is not resistant against electrochemical processes resulting in either partial or complete lack of adhesion between the solid metal and mercury. The probability and intensity of these processes are dependent on the quality of the initial wetting of the solid metal with mercury.

The hitherto known method would not provide for adequately wetting the surface of the above mentioned solid metals with mercury, on account of microcavities left in most cases at the contact junction under the mercury film and containing an electrochemically active medium, e.g. the remains of acids, water and other electrolytes employed by the production process.

These microcavities act as the nuclei of degrading electrochemical processes affecting the stability and durability of the solid metal-mercury contact junction.

The necessity for suppressing these degrading electrochemical processes significantly complicates the technology of wetting the surface of the hard or solid metal with mercury, and of the manufacture of the contact.

BRIEF DESCRIPTION OF THE INVENTION

It is an object of the present invention to provide a mercury contact wherein the solid-metal base is very electrochemically stable and inert with respect to mercury.

It is another object of the present invention to provide a method of manufacturing a mercury contact, which adequately wets the surface of the solid metal base with mercury.

It is a further object of the present invention to simplify the technology of manufacturing the mercury contact.

The object of the present invention is attained in a mercury contact wherein, in accordance with the invention, the mercury-wetted solid metal base is made of antimony.

The object of the present invention is further attained in a method of manufacturing a mercury object, including successively preparing a solid metal base and coating it with a layer of mercury. The method, in accordance with prepares the invention, the solid metal base of the contact by electrolytic deposition of antimony onto a substrate.

It is expedient that the mercury layer be applied by electrolytic deposition of mercury onto antimony.

The herein disclosed mercury contact and method of its manufacture provide for an adequate quality of wetting of the surface of the solid metal base with mercury and substantially reduces the electrochemical activity of the solid metal base in contact with mercury, which yields the improved stability and durability of the mercury contact.

Furthermore, the presence in the manufacturing technology of similar operations of electrolytic deposition significantly simplifies the manufacture of a mercury contact.

DETAILED DESCRIPTION OF THE INVENTION

The invention will be further described in connection with an embodiment thereof.

The solid metal base of the herein disclosed mercury contact includes a substrate or backing which is a component of the switching device, coated with a layer of antimony, the surface of antimony being wetted with mercury.

Antimony combines several positive properties of both noble and ignoble metals, including its being inert with respect to oxygen. This property of antimony provides for fine wetting of the solid metal base with mercury, without the necessity of employing a multioperation technology to attain the same result, and also without the necessity of resorting to strict evacuation techniques.

Furthermore, owing to its high electrochemical stability and being inert with respect to mercury, antimony prevents degrading processes from occurring at the antimony-mercury junction.

The ability of antimony to be electrolytically deposited from a solution in the form of a compact, finely crystalline deposit which, owing to its surface-structural properties, enhances the adhesion of mercury to the antimony surface, and enables the manufacture of a mercury contact in a series of relatively simple similar operations of successive electrolytical deposition onto the substrate (i.e. the component of the switching device), first, of antimony, and then of mercury.

What we claim is:

1. An electric switching device comprising a mercury contact having a solid metal base of antimony wetted with mercury, wherein the antimony base is electrochemically stable and inert with respect to the mercury.

* * * * *